US007225558B2

(12) United States Patent
Hagen et al.

(10) Patent No.: US 7,225,558 B2
(45) Date of Patent: Jun. 5, 2007

(54) CROSS-MACHINE FLOW AND PROFILE CONTROL FOR THROUGH-AIR DEVICES TREATING PERMEABLE WEBS

(75) Inventors: Stephen Charles Hagen, Kennebunk, ME (US); Stephen Bradford Peterson, Cape Elizabeth, ME (US); Jeffrey Croteau, Portland, ME (US); Richard Alan Parker, Cape Elizabeth, ME (US)

(73) Assignee: Metso Paper USA, Inc., Biddeford, ME (US)

( * ) Notice: Subject to any disclaimer, the term of this patent is extended or adjusted under 35 U.S.C. 154(b) by 229 days.

(21) Appl. No.: 10/903,562

(22) Filed: Jul. 30, 2004

(65) Prior Publication Data

US 2006/0021249 A1 Feb. 2, 2006

(51) Int. Cl.
*F26B 11/02* (2006.01)

(52) U.S. Cl. ..... 34/124

(58) Field of Classification Search ..... 34/115, 34/117, 119, 122, 124; 162/204, 205
See application file for complete search history.

(56) References Cited

U.S. PATENT DOCUMENTS 3,303,576 A 2/1967 Sisson
3,432,936 A 3/1969 Cole et al.
3,675,337 A 7/1972 Daane
4,542,596 A 9/1985 Bryand et al.
4,617,792 A * 10/1986 Stahlecker ..... 57/401
5,020,242 A * 6/1991 Mayer et al. ..... 34/115
5,371,954 A * 12/1994 Pinter et al. ..... 34/115
5,937,538 A 8/1999 Joiner
5,974,684 A * 11/1999 Steiner et al. ..... 34/115
6,079,116 A 6/2000 Jewitt et al.
6,470,598 B2 10/2002 Ringer
7,040,038 B1 * 5/2006 Beaumont ..... 34/114

* cited by examiner

*Primary Examiner*—S. Gravini
(74) *Attorney, Agent, or Firm*—Pierce Atwood LLP; Kevin M. Farrell; Katherine A. Wrobel

(57) ABSTRACT

A through-air device includes a permeable roll having a hollow interior and mounted for rotation about a longitudinal axis. At least one divider is located in the hollow interior so as to define a plurality of roll channels within the roll, the roll channels being positioned side-by-side along the longitudinal axis. A first housing bounds a first portion of the roll, and a second housing bounds a second portion of the roll. At least one partition is located in the second housing so as to define a plurality of housing channels within the second housing. Each one of the housing channels is aligned with a corresponding one of the roll channels. The device further includes structure for individually controlling airflow through each pair of corresponding roll channels and housing channels.

19 Claims, 11 Drawing Sheets

CROSS-MACHINE FLOW AND PROFILE CONTROL FOR THROUGH-AIR DEVICES TREATING PERMEABLE WEBS

BACKGROUND OF THE INVENTION

This invention relates generally to through-air devices (TADs) and more particularly to controlling moisture or other profiles in webs being treated by TADs. As used herein, the term "through-air device" generally refers to a device for drawing a fluid (typically a gas such as heated air, ambient air, combustion products and/or a vapor, although a liquid such as water can be used in some applications) through permeable webs to treat the webs. Thus, the use of the word "air" in "through-air device" is in no way limiting to air. It should be understood that reference to the term "air" hereinafter includes other fluids as well. Common examples of TADs include through-air dryers, bonders and curers. Other applications of TADs include extraction, cooling, moisturizing, washing and porosity measurements.

In many web processing methods, such as paper making, TADs are used for drying the web after, before or instead of pressing devices. Typically, such a TAD incorporates a hollow, rotating roll fitted with a perforated or otherwise permeable shell around which a wet web is partially wrapped as the web is passed through the TAD. The web is often supported on a continuous fabric as it is passed through the TAD. Heated air (gas or vapor) passes through the permeable web, fabric and roll so as to cause drying of the web.

In through-air thermal processes such as drying, the web necessarily serves as a flow resistance. The local magnitude of this resistance can vary as local web properties, such as basis weight and moisture content, vary across the width of the web and thus the flow of the supply air, even when uniformly distributed upstream of the web, can grow non-uniform as it approaches the web. For example, in a drying process, more air can flow through drier, lighter or more-permeable portions of the web, tending to exacerbate existing cross-machine moisture profiles. The problem of inherent web non-uniformity is compounded by the airflow arrangement used in many TADs; that is, the air is typically exhausted through one or both ends of the roll. This introduces an inherent tendency for through-air flow to favor the exhaust side or sides, resulting in diminished drying, bonding or curing rates on the opposite end or center of the web. Means exist to compensate for or correct this flow bias but they require the introduction of pressure losses (i.e., increased energy consumption and production costs.)

In addition, the air delivered to the supply plenum, just upstream of the web's surface, is not always distributed uniformly with respect to both temperature and air speed. Non-uniformity can result from such things as poor mixing upstream or thermal loss. Thermal loss through duct walls tends to depress the supply air temperature on both sides of the supply plenum while air speed can be expected to decrease near the plenum walls. Thus, there exists a tendency to under treat the outermost edges of the web. Any non-uniformity in supply and exhaust air density (due to temperature and/or air speed variation) can result in the development of a cross-machine pressure gradient within the gap between the supply plenum and surface of the TAD roll. There can thus be a tendency for supply air to "blow-out" from within this gap into the machine room or for ambient air to be sucked into the gap.

Furthermore, when threading a production line, the web is typically first introduced to the TAD as a narrow strip (referred to as the tail) which occupies only a fraction of the full production width. This means that supply air tends to flow around the web through that portion of the TAD roll's surface offering the least resistance resulting in ineffective thermal treatment of the tail and the tail not being properly secured on the surface of the roll. It is desirable to process (e.g., dry or bond) the tail as the integrity (strength) of the tail is increased, thereby making any handling operations downstream of the TAD easier and more efficient. The treading process through the TAD is less problematic and more secure when the tail is firmly held to the roll surface.

TADs currently rely on profiling devices, installed within the TAD roll, to eliminate cross-machine flow non-uniformity due to duct configuration. Web non-uniformity resulting from such causes as varying web characteristics, supply and gap pressure imbalance, and transients, such as threading, has generally not been addressed. Typical control devices consist of perforated tubes, mounted within the roll, that offer either a varying flow resistance (smaller or fewer perforations approaching the exhaust end or ends of the roll) or a resistance that substantially exceeds or overpowers that due to the web itself. In both instances, system pressure loss due to the profiling device can be large. In neither approach can the resistance be easily reduced or increased or otherwise adjusted to suit the specific conditions obtained when producing a given web. The devices are thus typically sized for worst-case operating scenarios such that much of the pressure loss associated with their use can be considered parasitic when producing off-design webs.

Accordingly, there is a need for a TAD that can accommodate inherent upstream, cross-machine variation in web characteristics, as well as supply air non-uniformity within the TAD, to produce webs exhibiting more uniform treatment (such as moisture, bonding or curing profiles) downstream of the TAD.

SUMMARY OF THE INVENTION

The above-mentioned need is met by the present invention, which provides a TAD including a permeable roll having a hollow interior and mounted for rotation about a longitudinal axis. At least one divider is located in the hollow interior so as to define a plurality of roll channels within the roll, the roll channels being positioned side-by-side along the longitudinal axis. A first housing bounds a first portion of the roll, and a second housing bounds a second portion of the roll. At least one partition is located in the second housing so as to define a plurality of housing channels within the second housing. Each one of the housing channels is aligned with a corresponding one of the roll channels. The dryer further includes means for individually controlling airflow through each pair of corresponding roll channels and housing channels.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
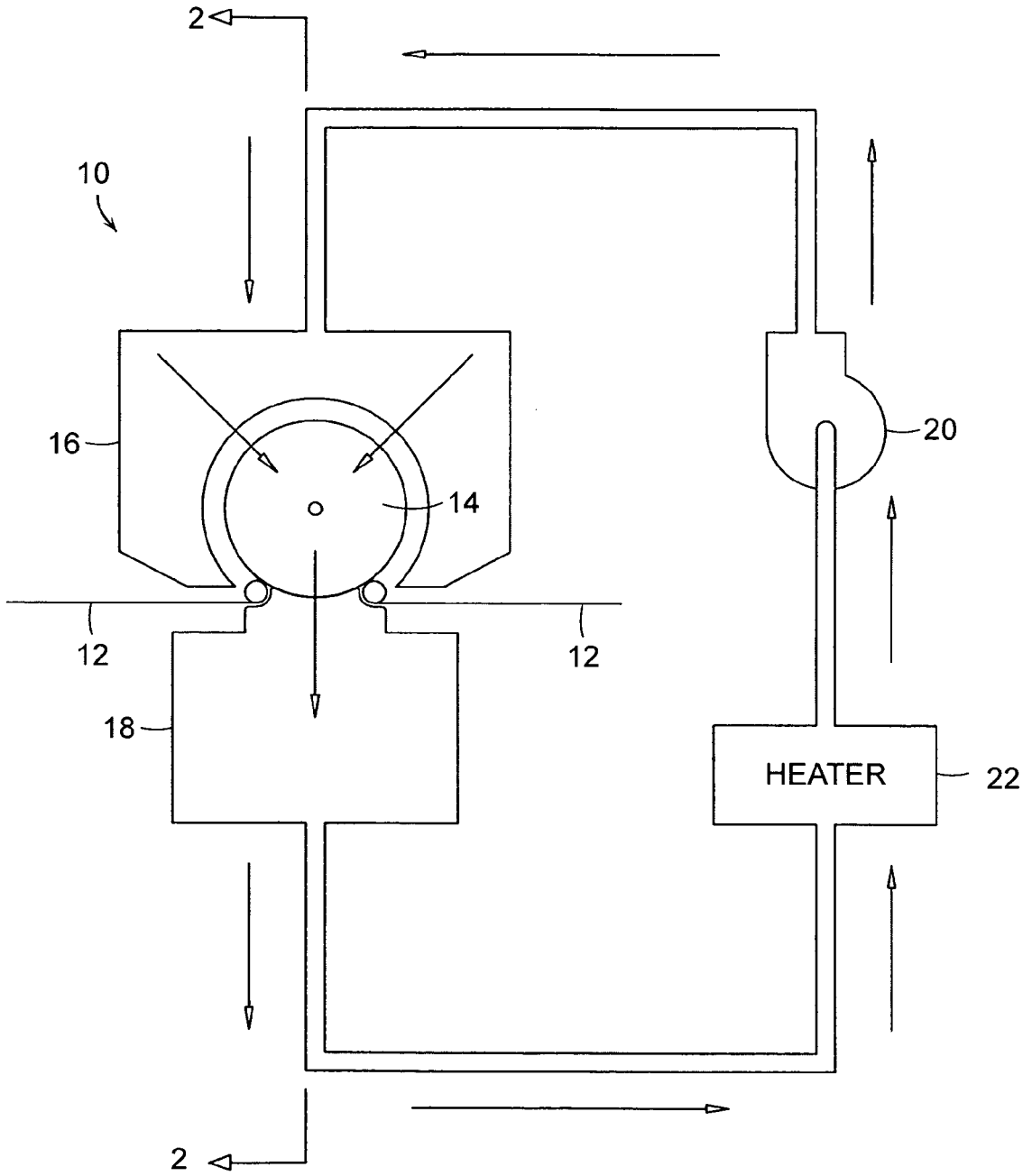
FIG. 1 is a schematic view of a TAD in accordance with one embodiment of the present invention.

Referring to the drawings wherein identical reference numerals denote the same elements throughout the various views, FIG. 1 shows a through-air device (TAD) 10 constructed in accordance with one embodiment of the present invention. By way of example, the TAD 10 illustrated in FIG. 1 is a through-air dryer that can be used for drying a permeable web 12 of material, including paper products such as tissue and paper towel, nonwoven materials and textiles. However, it should be noted that the present invention is not limited to dryers and can apply to any through-air device used to treat (thermally or otherwise) a permeable web. The basic components of the illustrated TAD 10 include a generally cylindrical, hollow roll 14 about which the web 12 is partially wrapped. The web 12 may be self supporting, but for many paper or tissue applications, it is supported by a permeable fabric of a known type which functions in a manner similar to a conveyor belt. The roll 14 is rotatively supported about its longitudinal axis on a journal. A stationary centerpipe 15 (FIG. 2) extends through the journal along the roll's longitudinal axis. Conventional means such as an electric motor (not shown) are provided for rotating the roll 14. The surface of the roll 14 is permeable and may be of various constructions such as perforated sheet metal, honeycomb, expanded metal, etc.

The TAD 10 has a "machine direction" which refers generally to the overall direction of the movement of the web 12, which would be from left to right in FIG. 1, for example. The TAD 10 also has a "cross-machine direction" which refers to an axis perpendicular to the direction of web movement, which in the illustrated example is parallel to the axis of rotation of the roll 14. In drying applications, the portion of the TAD 10 where the web 12 enters is generally referred to as its "wet end," while the portion where the web 12 exits is referred to as its "dry end."

The roll 14 is substantially enclosed by a first housing or hood 16 and a second housing 18. The first housing 16 preferably bounds a substantial portion of the circumference of the roll 14, and the second housing 18 bounds the remaining roll circumference, with relatively small gaps between the two housings to allow for the passage of the web 12. Conventional turn rolls are located adjacent to these gaps to support the web carrying fabric (if used) and the web 12 as they enter and exit the TAD 10. The first housing 16 is shown mounted above the roll 14, and the second housing 18 is shown mounted below the roll 14. However, this positioning is of no special importance to the present invention and the housings could be mounted in other positions with respect to the roll 14. The first housing 16 defines a supply plenum that supplies heated air to the exterior of the roll 14, and the second housing 18 defines an exhaust plenum for exhausting air that has passed through the web 12 and the roll 14. The TAD 10 further includes a pump 20, such as a fan or a blower, for moving air through the system, and at least one heater 22, both of which are connected by suitable ducting to form a closed loop as shown in FIG. 1. The term "heater" is used herein to refer to any device used primarily to increase the temperature of the air flowing through it. For example, the heater 22 may be a combustion heater which burns a fuel therein, or it may be a heat exchanger that transfers heat to the air flow from a flow of high-temperature fluid (such as an industrial steam supply).

In a drying operation, the moisture-laden web 12 enters the TAD 10 at the wet end, passes around the rotating roll 14, and exits the TAD 10 at the dry end. Heated air from the heater 22 is supplied to the interior of the first housing 16. The air passes through the web 12, the web carrying fabric (if used), and the permeable surface of the roll 14 into the interior of the roll 14, which is maintained at a slightly negative pressure by virtue of its fluid communication (via the second housing 18) with the intake side of the pump 20. The passing web 12 is dried by the flow of heated air. From the interior of the roll 14, the air again passes through the permeable surface of the roll 14 into the exhaust plenum of the second housing 18. The air then returns to the pump 20 and the heater 22 where the cycle repeats. It should be noted that the relative positioning of the pump 20 and the heater 22 can be interchanged. The system can include a make-up air duct and a relief duct that allow air to be added or removed from the system to maintain a constant airflow.

The web 12, which has been formed in a process upstream of the TAD 10 (for example by deposition from a headbox of a known type), will typically have a moisture profile in the cross-machine direction resulting from non-uniformities in the upstream process. To correct undesirable moisture profiles, the present invention splits the air flow supplied to the web 12 in the TAD 10 into channels situated across the width of the web 12 (i.e., in the cross-machine direction) and introduces a secondary flow resistance (in addition to the flow resistance of the web itself) within each channel that can be individually adjusted. The flow within each channel can thus be metered to correct web moisture profiles resulting from cross-machine variations in web characteristics, non-uniformity in the cross-machine distribution of supply air, pressure imbalance within the gap between the supply plenum and the roll surface, and preferential flow paths inherent in typical exhaust duct configurations.

Figure 2:
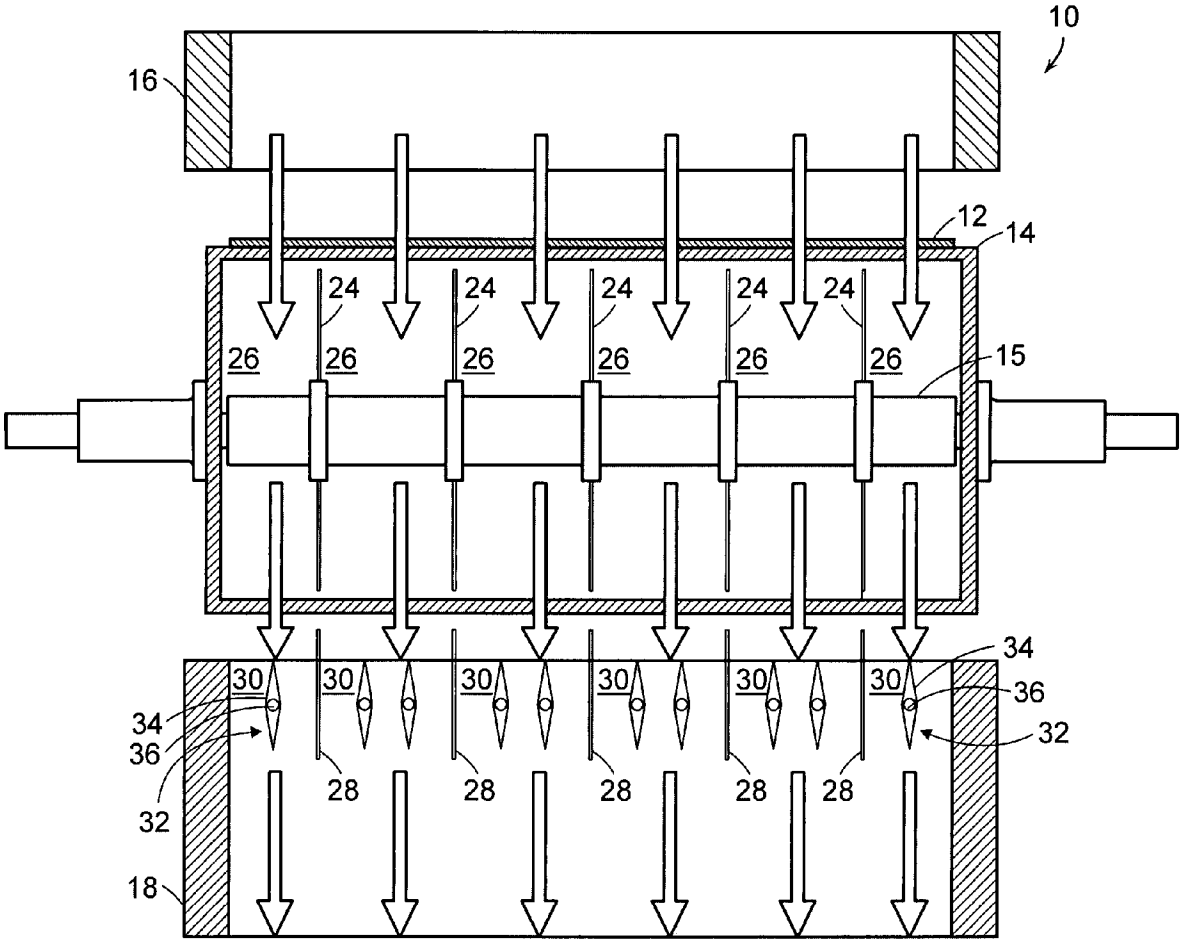
FIG. 2 is a sectional view of the TAD taken along line 2—2 of FIG. 1.
Figure 3:
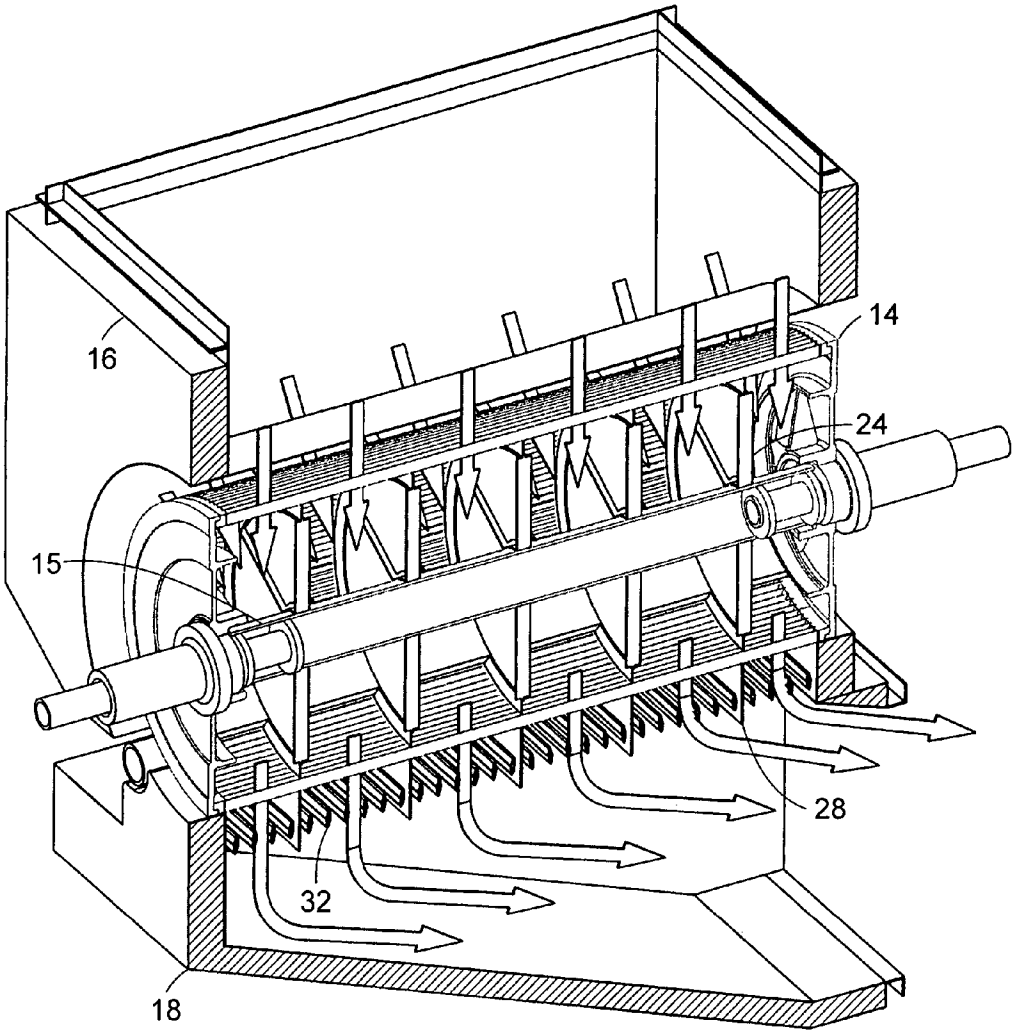
FIG. 3 is a cut-away perspective view of the TAD.

Turning to FIGS. 2 and 3, a plurality of flow dividers 24 is located in the hollow interior of the roll 14 so as to define a plurality of roll channels 26 within the roll 14. The dividers 24 are mounted perpendicular to the roll's longitudinal axis, resulting in the roll channels 26 being positioned side-by-side along the longitudinal axis to divide the roll 14 in the cross-machine direction. While FIGS. 2 and 3 show five dividers 24 (creating six roll channels 26) by way of example, it should be noted that any number, including just one, of dividers 24 can be employed. The dividers 24 are thin, annular discs, preferably of sheet metal, extending from the centerpipe 15 toward the inside diameter of the roll 14. In the illustrated embodiment, the annular dividers 24 are fixed to the stationary centerpipe 15 (where the roll 14 rotates relative to the centerpipe 15). In this case, the outer edges of the dividers 24 do not contact the inside of the roll 14 but come very close thereto to effectively separate flow between the roll channels 26. Alternatively with a stationary centerpipe, the dividers could be fixed to the inner surface of the roll 14 and slightly spaced from the centerpipe 15, although the centerpipe could be eliminated where the dividers are fixed to the inner roll surface. In the case of a rotating centerpipe (where the centerpipe and the roll jointly rotate on bearings), the annular dividers 24 could be fixed to the centerpipe and to the inner surface of the roll.

The TAD 10 further includes a plurality of partitions 28 fixedly mounted in the second housing 18 so as to define a plurality of housing channels 30 within the second housing 18. Like the dividers 24, the partitions 28 are mounted perpendicular to the roll's longitudinal axis. Thus, the housing channels 30 are positioned side-by-side across the second housing 18 in the cross-machine direction. The partitions 28 are thin plates, preferably of sheet metal, having one edge curved to match the portion of the roll circumference bounded by the second housing 18. The partitions 28 thus define ring segments of a length substantially equal to the depth, in the machine direction, of the upper portion of the second housing 18. The number of partitions 28 is equal to the number of dividers 24, and the partitions 28 are located across the second housing 18 in the cross-machine direction so as to be axially aligned with a corresponding one of the dividers 24. Accordingly, each housing channel 30 is axially aligned with a corresponding one of the roll channels 26. Each aligned pair of roll channels 26 and housing channels 30 thereby defines an independent flow path through the TAD 10.

A flow control assembly 32 is provided in each housing channel 30 to individually control air flow through the respective housing channel 30 (and thus its corresponding roll channel 26). In one possible embodiment, each flow control assembly 32 comprises one or more rotatable dampers 34 mounted on an axle 36. The axles 36 are mounted in the second housing 18 so as to extend in the machine direction. The dampers 34 can be rotated in a conventional manner (such as by an actuator) between a fully open position (shown in FIG. 2) and a fully closed position in which the dampers 34 block airflow through the corresponding channels (see the rightmost damper 34 in FIG. 4). The dampers 34 can also be situated in any position between fully open and fully closed (see center dampers 34 in FIG. 4) so as to partially block airflow through the corresponding channels. It should be noted that the partitions 28 and the flow control assemblies 32 alternatively could be located in the first housing 16, instead of the second housing 18.

Because the flow of air through each pair of corresponding roll channels 26 and housing channels 30 can be controlled individually with the flow control assemblies 32, this arrangement allows for the correction of undesirable profiles (e.g., moisture, bonding or cure profiles) across the width of the web 12 by adjusting or metering the flow through different portions of the web in the cross-machine direction. Thus, the present invention is able to correct web profiles resulting from a variety of causes such as non-uniformity in web characteristics (basis weight, moisture content and/or permeability), non-uniformity in airflow inherent to the TAD, and the like.

While the above discussion describes a TAD that uses heated air for drying a web by way of example, the present invention is not limited to the use of heated air or drying applications. Many other types of working fluids, such as ambient air, combustion products, vapors, water, and the like, can be used for various applications. TADs having cross-machine flow and profile control in accordance with the present invention can be used for many additional applications such as bonding, curing, extraction, cooling, moisturizing, washing and porosity measurements.

Figure 4:
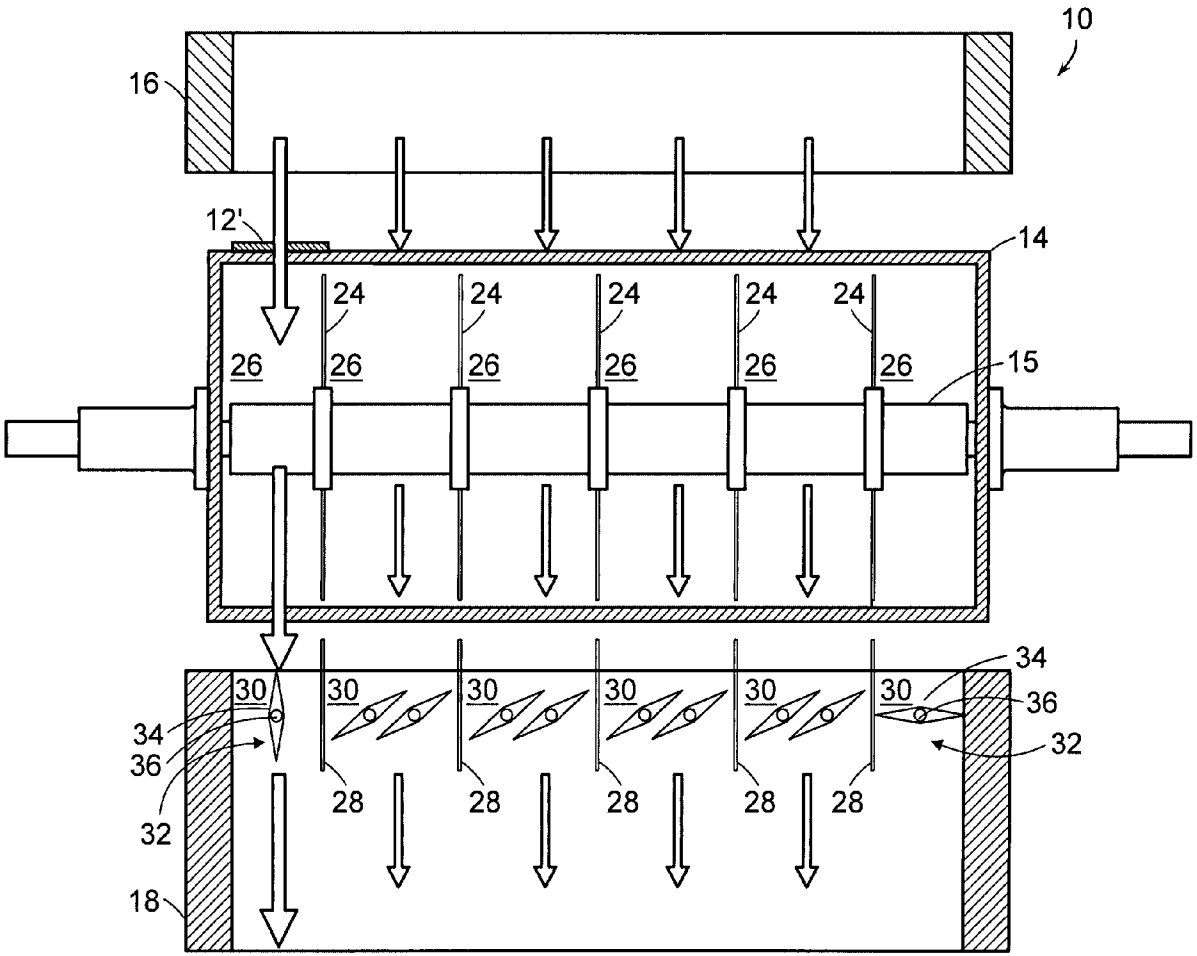
FIG. 4 is a sectional view of the TAD configured for a threading operation.

The present invention can be used to accommodate transient operations such as threading a tail when initiating a production line. Referring to FIG. 4, the TAD 10 is shown configured for threading a narrow web or tail 12'. In this case, the tail 12' is disposed over the roll 14 and occupies only a small section of the roll 14 in the cross-machine direction, which is typically on the tending side (i.e., operator side) of the TAD 10. As shown in FIG. 4, the flow control assemblies 32 in all of the housing channels 30 except for the housing channel 30 that the tail 12' is aligned with (the leftmost channel in FIG. 4) are either entirely or substantially closed so the airflow is substantially limited to passing through the tail 12' for better, more efficient drying of the tail. As the web is gradually widened at the end of the threading operation, the flow control assemblies 32 are sequentially opened to dry the entire width.

Figure 5:
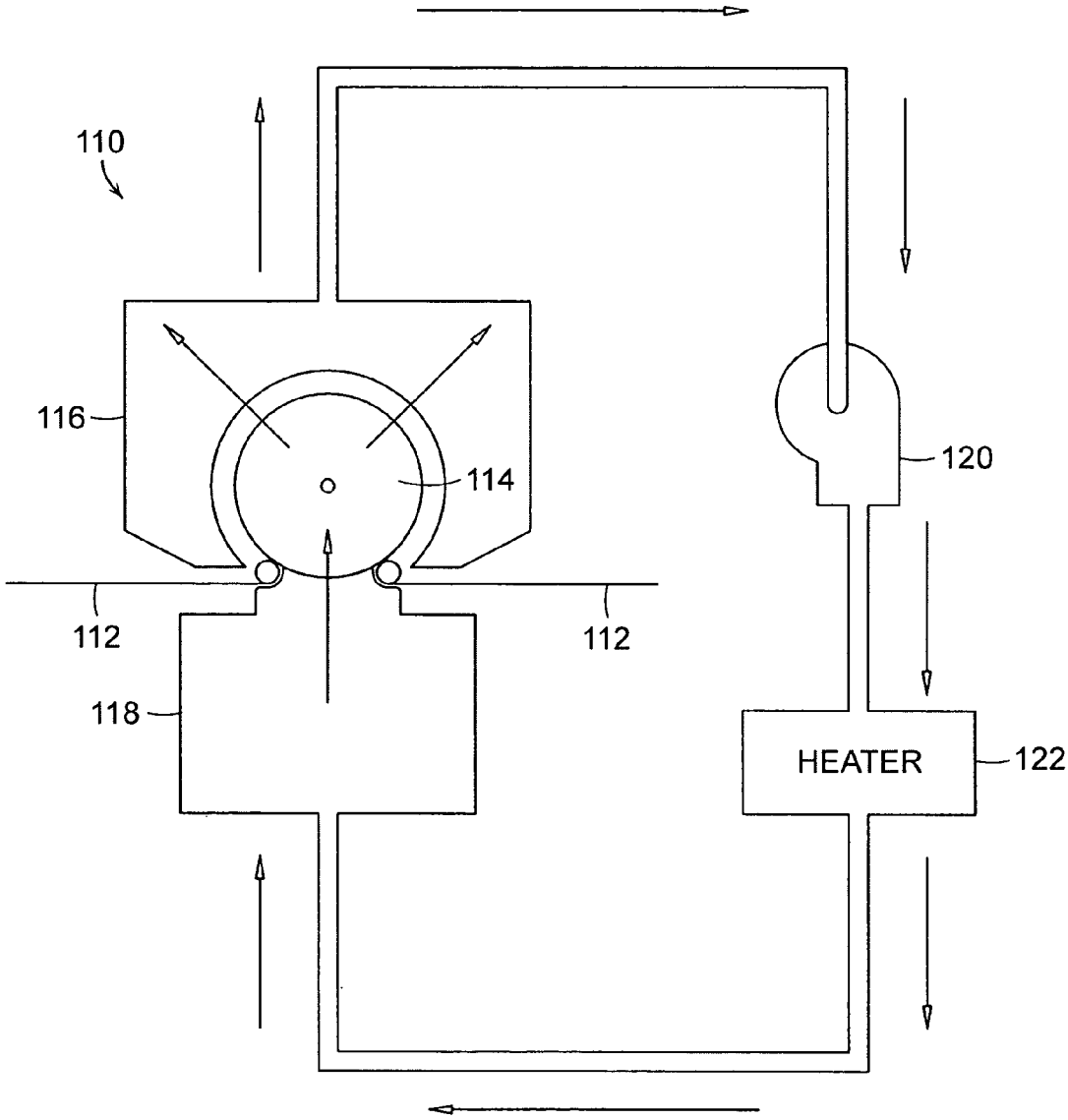
FIG. 5 is a schematic view of a TAD in accordance with another embodiment of the present invention.

Referring now to FIG. 5, an alternative embodiment of a TAD 110 for treating a permeable web 112 is shown. The basic components of the TAD 110 include a generally cylindrical, hollow roll 114 about which the web 112 is partially wrapped. The web 112 may be self supporting or may be supported by a permeable fabric of a known type. As in the first embodiment, the roll 114 is rotatively supported about its longitudinal axis on a centerpipe in a known manner and has a permeable surface.

The roll 114 is substantially enclosed by a first housing 116 and a second housing 118. The first housing 116 preferably bounds a substantial portion of the circumference of the roll 114, and the second housing 118 bounds the remaining roll circumference, with relatively small gaps between the two housings to allow for the passage of the web 112. The first housing 116 is shown mounted above the roll 114, and the second housing 118 is shown mounted below the roll 114. However, this positioning is of no special importance to the present invention and the housings could be mounted in other positions with respect to the roll 114. In this embodiment, the second housing 118 defines a supply plenum that supplies heated air to the exterior of the roll 114, and the first housing 116 defines an exhaust plenum for exhausting air that has passed through the web 112 and the roll 114. The TAD 110 further includes a pump 120, such as a fan or a blower, for moving air through the system, and at least one heater 122 which are both connected by suitable ducting to form a closed loop as shown in FIG. 5.

In a drying operation, the moisture-laden web 112 enters the TAD 110 at the wet end, passes around the rotating roll 114, and exits the TAD 110 at the dry end. Heated air from the heater 122 is supplied to the interior of the second housing 118. The air passes through the permeable surface of the roll 114 into the interior of the roll 114. From the roll interior, the air again passes through the permeable surface of the roll 114, through the web 112, the web carrying fabric (if used) and into the exhaust plenum of the first housing 116. With this configuration, the web 112 is disposed between the web carrying fabric and the roll 114 so hot air passes through the web 112 before the web carrying fabric. The passing web 112 is dried by the flow of heated air. The air then returns to the pump 120 and the heater 122 where the cycle repeats. It should be noted that the relative positioning of the pump 120 and the heater 122 can be interchanged. The system can include a make-up air duct and a relief duct that allow air to be added or removed from the system to maintain a constant airflow.

The TAD 110 thus differs from the first embodiment in that the direction of heated airflow is from the inside of the roll 114 to the outside instead of outside in. The TAD 110 is essentially the same with respect to correcting web profiles. That is, the roll 114 has a plurality of flow dividers located therein so as to define a plurality of roll channels within the roll 114, similar to that shown in FIGS. 2 and 3. The TAD 110 further includes a plurality of partitions defining a plurality of housing channels and a flow control assembly disposed in each housing channel, again similar to that shown in FIGS. 2 and 3. The roll channels and the housing channels are axially aligned. The partitions and flow control assemblies are preferably located in the second housing 118, but alternatively can be located in the first housing 116. The operation of the TAD 110 is the same in that the flow control assemblies are operated to individually control the flow through each pair of corresponding roll channels and housing channels.

Figure 6A:
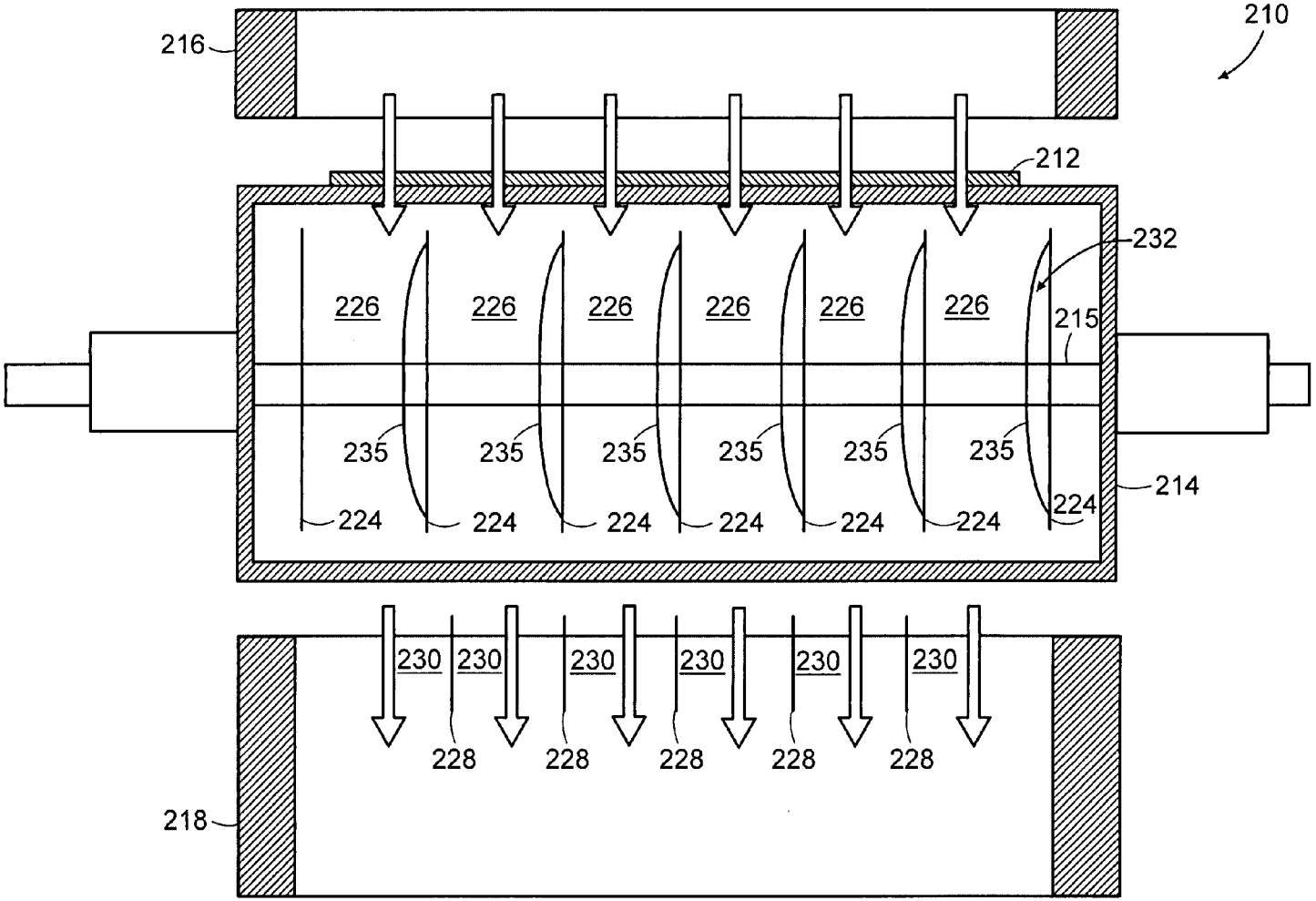
FIGS. 6A and 6B are sectional views of a TAD in accordance with another embodiment of the present invention.
Figure 6B:
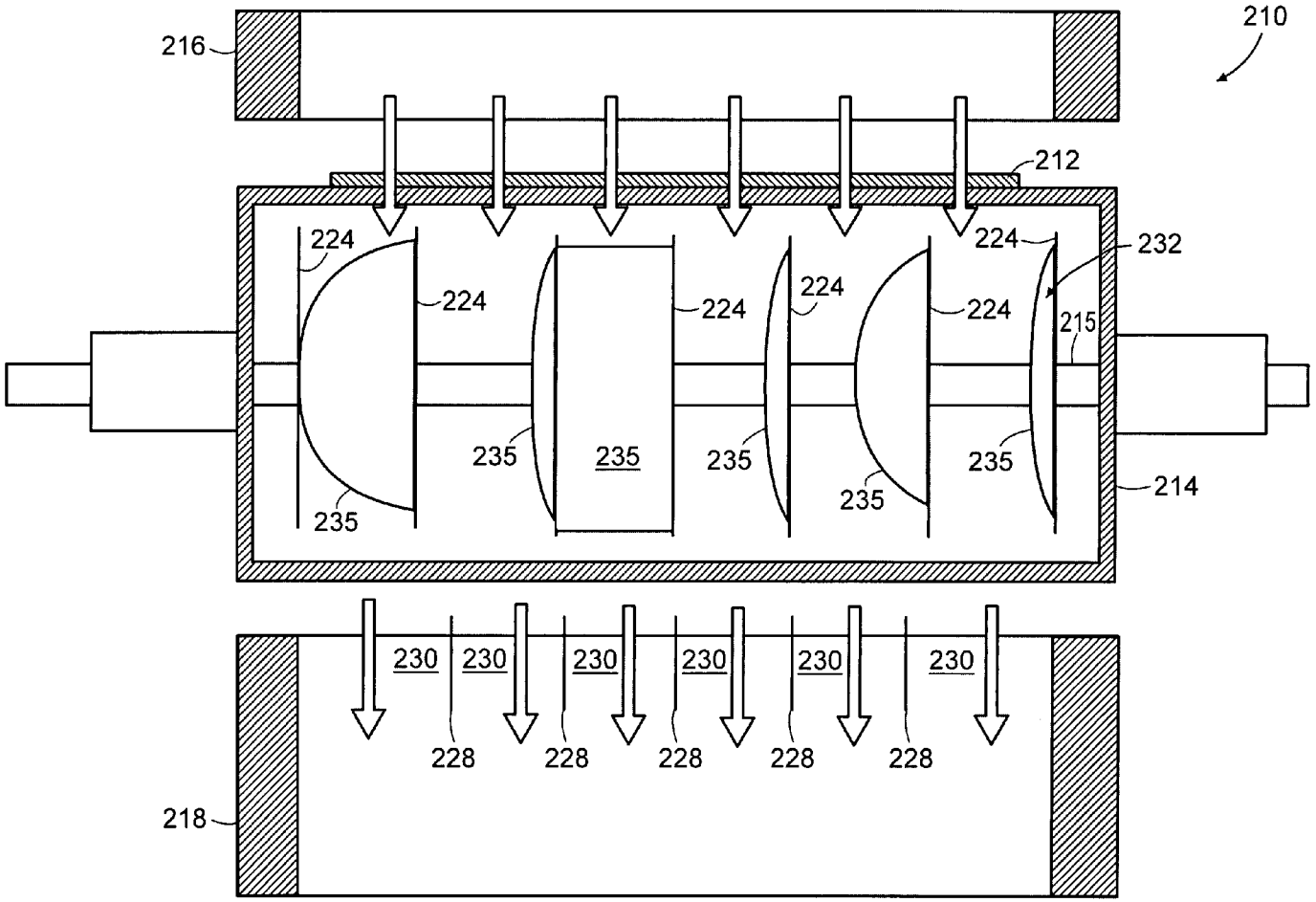

Turning to FIGS. 6A and 6B, another alternative embodiment of a TAD 210 for treating a permeable web 212 is shown. The basic components of the TAD 210 include a generally cylindrical, hollow roll 214 about which the web 212 is partially wrapped. The web 212 may be self supporting or may be supported by a permeable fabric of a known type. As with the prior embodiments, the roll 214 is rotatively supported about its longitudinal axis on a centerpipe 215 in a known manner and has a permeable surface.

The roll 214 is substantially enclosed by a first housing 216 and a second housing 218. The first housing 216 preferably bounds a substantial portion of the circumference of the roll 214, and the second housing 218 bounds the remaining roll circumference, with relatively small gaps between the two housings to allow for the passage of the web 212. The first housing 216 is shown mounted above the roll 214, and the second housing 218 is shown mounted below the roll 214. However, this positioning is of no special importance to the present invention and the housings could be mounted in other positions with respect to the roll 214. In this embodiment, the first housing 216 defines a supply plenum that supplies heated air to the exterior of the roll 214, and the second housing 218 defines an exhaust plenum for exhausting air that has passed through the web 212 and the roll 214. Although not shown in FIGS. 6A and 6B, the TAD 210 further includes a pump, such as a fan or a blower, for moving air through the system, and at least one heater for heating the air.

The roll 214 has a plurality of flow dividers 224 located therein so as to define a plurality of roll channels 226 within the roll 214. The dividers 224 are mounted perpendicular to the roll's longitudinal axis, resulting in the roll channels 226 being positioned side-by-side along the longitudinal axis to divide the roll 214 in the cross-machine direction. The TAD 210 further includes a plurality of partitions 228 fixedly mounted in the second housing 218 so as to define a plurality of housing channels 230 within the second housing 218 (although the partitions could alternatively be located in the first housing 216). The partitions 228 are mounted perpendicular to the roll's longitudinal axis so that the housing channels 230 are positioned side-by-side across the second housing 218 in the cross-machine direction. The partitions 228 are located across the second housing 218 in the cross-machine direction so as to be axially aligned with a corresponding one of the dividers 224. Accordingly, each housing channel 230 is axially aligned with a corresponding one of the roll channels 226. Each aligned pair of roll channels 226 and housing channels 230 thereby defines an independent flow path through the TAD 210.

A flow control assembly 232 is provided in each roll channel 226 to individually control air flow through the respective roll channel 226 (and thus its corresponding housing channel 230). In one possible embodiment, each flow control assembly 232 comprises an expandable member 235, such as a bellows-type device, that is capable of being inflated via air lines (not shown) running out of the centerpipe 215 and in fluid communication with the interior of the corresponding expandable member 235. The expandable members 235 are preferably made of an expandable, temperature resistant fabric attached to the side of a respective one of the flow dividers 224. The expandable members 235 can be individually pneumatically actuated via the air lines between a fully deflated condition (shown in FIG. 6A) in which air flow is not restricted and a fully inflated condition in which the expandable member 235 blocks airflow through the corresponding channels (see the third-from-left expandable member 235 in FIG. 6B). The expandable members 235 can also be partially inflated (see leftmost and second-from-right expandable members 235 in FIG. 6B) so as to partially block airflow through the corresponding channels.

In a drying operation, the moisture-laden web 212 enters the TAD 210 at the wet end, passes around the rotating roll 214, and exits the TAD 210 at the dry end. Heated air is supplied to the interior of the first housing 216. The air passes through the web 212, the web carrying fabric (if used), and the permeable surface of the roll 214 into the interior of the roll 214. By selectively inflating the expandable members 235, the airflow is profiled in the cross-machine direction. The passing web 212 is dried by the flow of heated air.

Figure 10:
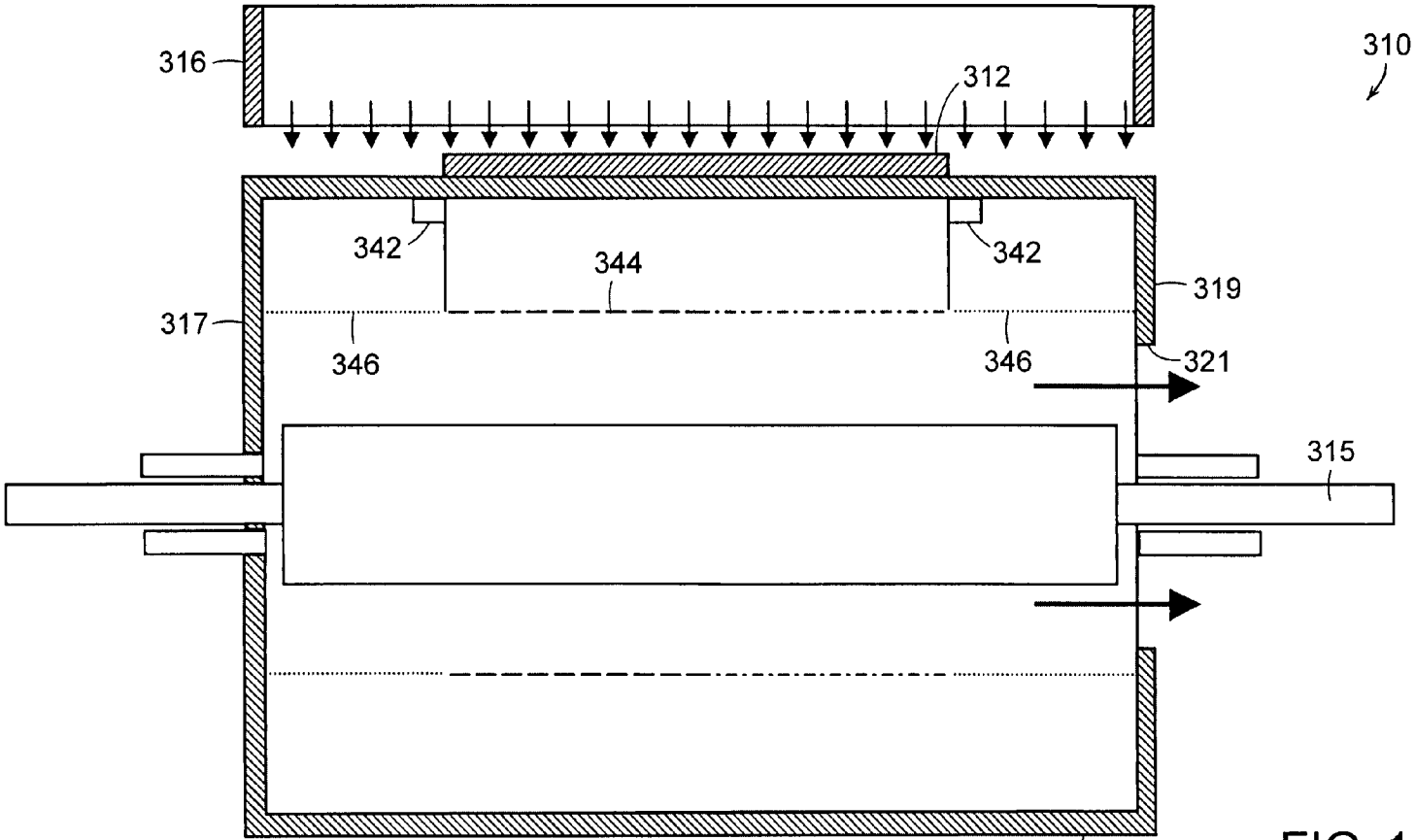
FIG. 10 (PRIOR ART)
FIG. 10 is a sectional view of a prior art end exhaust TAD.

TADs are often used to treat webs of different widths, and if the effective process width of the TAD does not match the sheet width, the edges of the sheet will not be effectively treated (e.g., dried, bonded or cured) thereby resulting in non-uniform web characteristics across the web. To accommodate webs of different widths, many TADs are provided with deckling. As used herein, the terms "deckling" and "deckle" refer to any means for adjusting the effective process width of a TAD to accommodate (or successfully treat) webs of different widths. FIG. 10 shows a conventional TAD 310 for treating a permeable web 312 that has deckling. The TAD 310 includes an end exhaust roll 314 rotatively supported about its longitudinal axis on a journal. A stationary centerpipe 315 extends through the journal along the roll's longitudinal axis. The roll 314 is a hollow roll having a permeable surface, a closed end head 317 and an open end head 319 having an opening 321 for exhausting air from the interior of the roll 314. The TAD 310 also includes moveable roll deckles 342 mounted inside the roll 314 that are adjustable for different width webs. A permeable air distribution tube 344 is located within the roll 314, approximately midway between the roll shell and the centerpipe 315.

The TAD 310 includes a hood 316 adjacent to the roll 314 that defines a supply plenum for supplying heated air to the exterior of the roll 314. The heated air passes through the web 312, the permeable surface of the roll 314, the air distribution tube 344, and exits the roll 314 via the opening 321 in the open end head 319. The air distribution tube 344 is perforated with the percent open area progressively decreasing from the closed head end to the open head end to yield uniform air flow through the web 312 from side-to-side. That is, the varying percent open area of the air distribution tube 344 produces a varying flow resistance that counters the cross-machine flow non-uniformity that results from the air being exhausted from one end.

The portion of the hood supply air outboard of the roll deckles 342 passes through the permeable roll surface without passing through the web 312. Because this air flow does not encounter the flow resistance of the web, there would be a tendency for air to leak into, or out of, the gap between the hood 316 and the roll 314. Accordingly, two permeable sheet (web) simulating plates 346 are provided within the roll 314, adjacent to the respective ends of the air distribution tube 344, to simulate the flow resistance of the web 312. The sheet simulating plates 346 have a constant percent open area calculated to match the permeability of the web 312, which is typically less than the percent open area of the air distribution tube 344. The portion of hood supply air passing through the roll 314 outboard of the roll deckles 342 is drawn through the sheet simulating plates 346. Because the percent open area of the sheet simulating plates 346 matches the permeability of the web 312, flow is balanced across the machine, and there is no tendency for air to leak into, or out of, the gap between the hood 316 and the roll 314.

The roll deckles 342 are shown in FIG. 10 at the minimum sheet width. The roll deckles 342 can be adjusted outwardly to permit the TAD 310 to treat wider webs. This adjustment would result in the roll deckles 342 overlapping the sheet simulating plates 346 to a small extent so that a portion of the sheet simulating plates 346 would be located inboard of the roll deckles 324. However, the portion of the sheet simulating plates 346 located inboard of the roll deckles 342 is typically quite small relative to the length of air distribution tube 344, so that the inboard airflow is essentially unaffected. The air flow outboard of the roll deckles 342 is still drawn through the sheet simulating plates 346 in the same manner described above.

Figure 7:
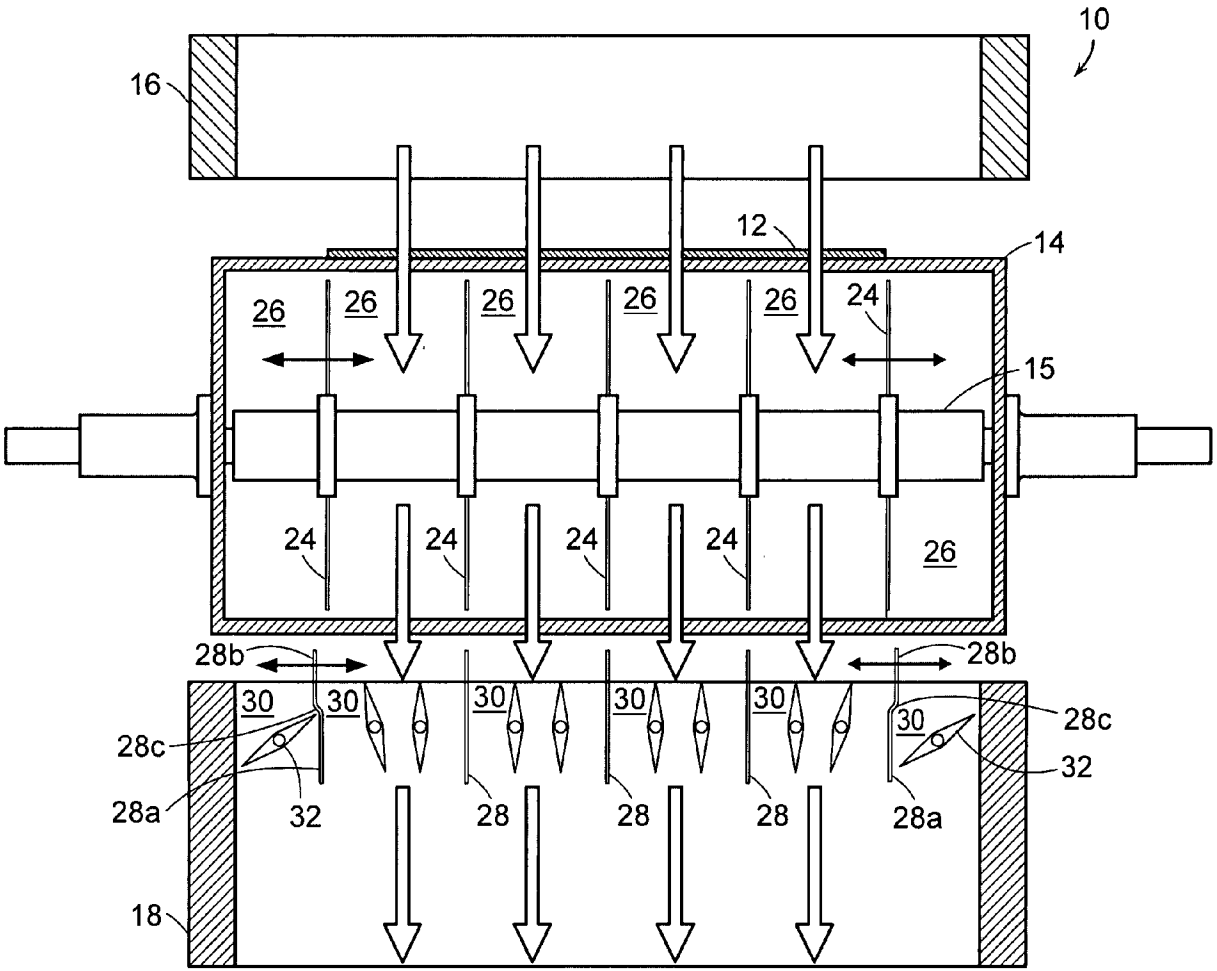
FIG. 7 is a sectional view of a modified version of the TAD.

Referring now to FIG. 7, a modified version of the TAD 10 described above is shown. In this version, the TAD 10 is provided with deckling so that its effective width can be varied to accommodate treating webs of different widths. In FIG. 7, the two outermost flow dividers 24 in the roll 14 (i.e., the dividers 24 closest to the ends of the roll 14) are axially movable so that their position is adjustable in the cross-machine direction. The position of these dividers 24 can be controlled by any suitable means such as a pulley and cable arrangement or lead screws passing through the stationary centerpipe 15. Similarly, the two outermost partitions 28 in the second housing 18 are made adjustable in the cross-machine direction. This is accomplished by constructing the two outermost partitions 28 from a stationary lower section 28*a* and a movable upper section 28*b* joined by a sheet of a flexible material 28*c* such as high temperature fabric. The position of upper sections 28*b*, include the curved edge that matches the portion of the roll circumference bounded by the second housing 18, is controlled by any suitable means. When the position of the upper sections 28*b* is changed, the width of the two outermost housing channels 30 changes accordingly. The flexible material 28*c* adjusts with the upper sections 28*b* to maintain flow separation between adjacent housing channels 30.

With this arrangement, the two outermost flow dividers 24 can be positioned in the cross-machine direction to align with the edges of the web 12, as depicted in FIG. 7, and the upper sections 28*b* can be positioned in the cross-machine direction to align with the corresponding flow divider 24. The two outermost flow control assemblies 32 can be partially opened to permit passage of air supplied outboard of the web 12 and thereby prevent it from leaking out of the TAD 10, thus functioning in the manner of a sheet simulating plate. That is, the function of sheet simulating plates can be achieved by partially opening the two outermost flow control assemblies 32 to restrict the flow through the outermost channels to the amount if the web was present, the flow restriction of the partially closed flow assemblies 32 being equal to the flow restriction presented by the web 12. An advantage of the present invention is that flow restrictions can more easily be adjusted to process webs of different permeability then with conventional sheet simulating plates, which typically have a fixed permeability.

Figure 8:
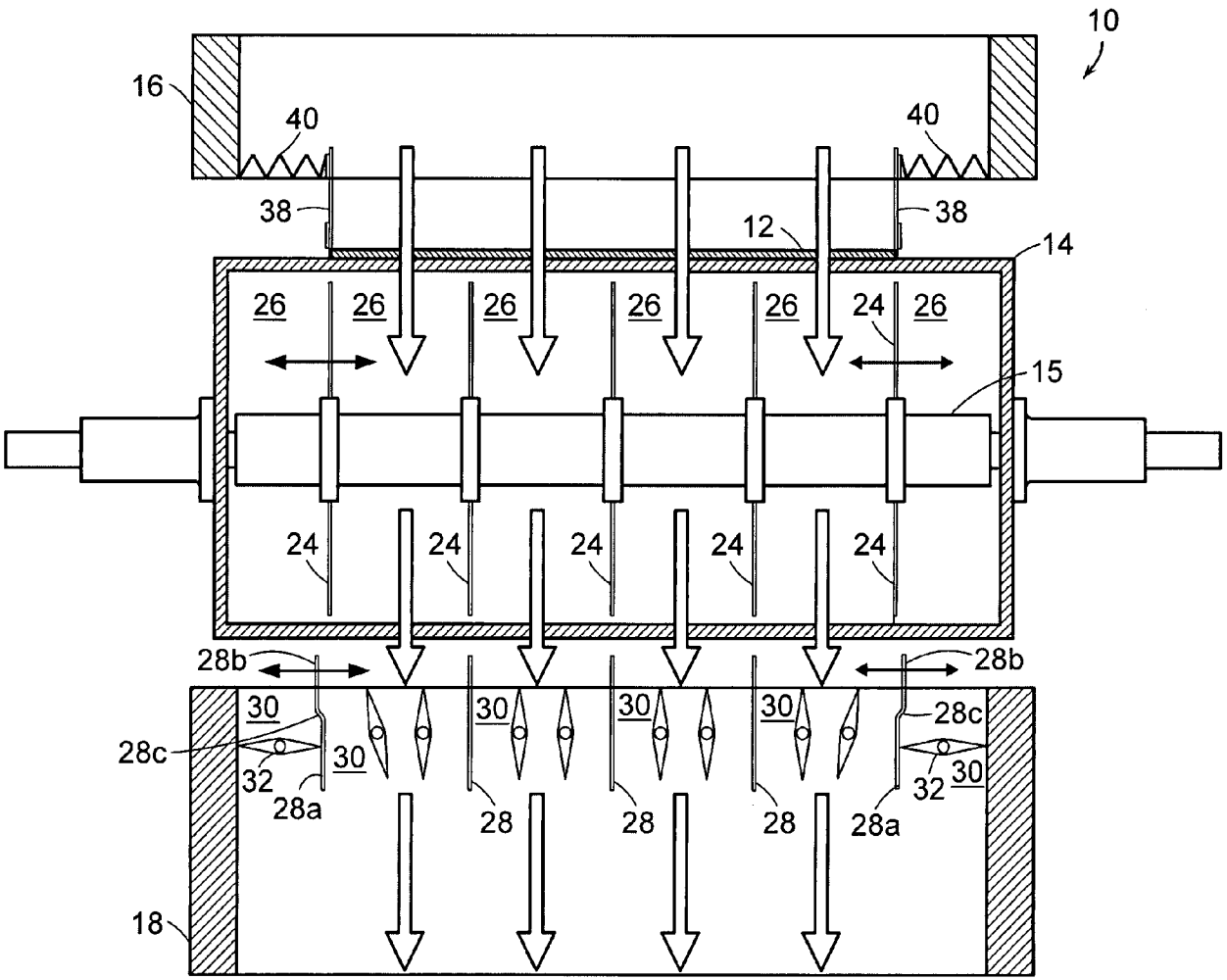
FIG. 8 is a sectional view of another modified version of the TAD.
Figure 9:
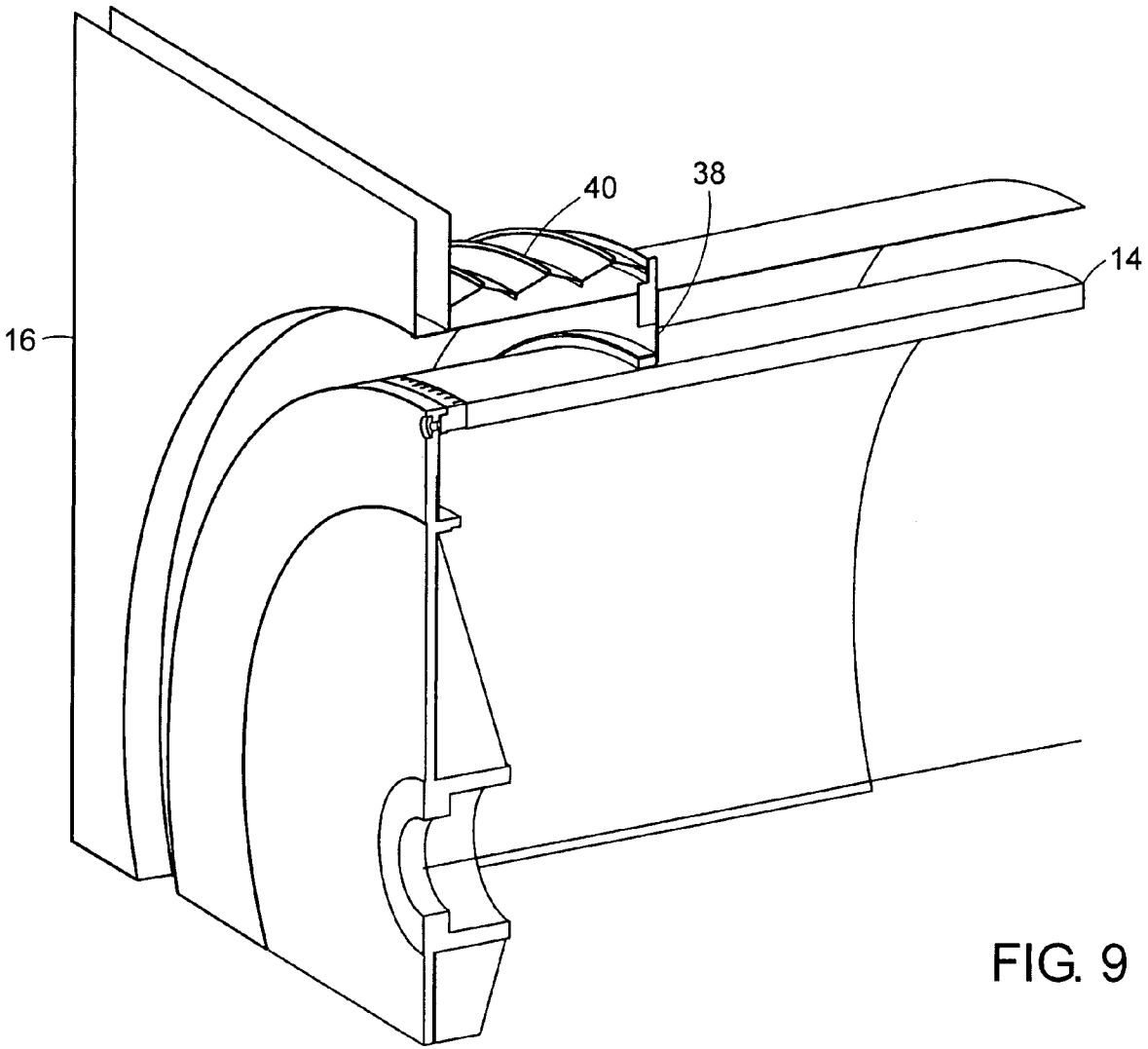
FIG. 9 is a partial, cut-away perspective view of the modified TAD of FIG. 8.

Referring to FIGS. 8 and 9, another modified version of the TAD 10 described above includes adjustable hood deckles that permit the effective width of the TAD 10 to be varied while retaining the features previously described. The use of hood deckles in TADs of conventional design (i.e., without the flow dividers and partitions of the present invention) has been previously contemplated. However, the use of hood deckles in the present invention is more practical because the sealing requirements are greatly reduced due to the presence of flow dividers and partitions. In this version, the two outermost flow dividers 24 in the roll 14 (i.e., the dividers 24 closest to the ends of the roll 14) are axially movable so that their position is adjustable in the cross-machine direction, as depicted in FIG. 8. The position of these dividers 24 can be controlled by any suitable means such as a pulley and cable arrangement or lead screws passing through the stationary centerpipe. Similarly, the two outermost partitions 28 in the second housing 18 are made adjustable in the cross-machine direction. This is accomplished by constructing the two outermost partitions 28 from a stationary lower section 28*a* and a movable upper section 28*b* joined by a sheet of a flexible material 28*c* such as high temperature fabric. The position of upper sections 28*b*, include the curved edge that matches the portion of the roll circumference bounded by the second housing 18, is controlled by any suitable means. When the position of the upper sections 28*b* is changed, the width of the two outermost housing channels 30 changes accordingly. The flexible material 28*c* adjusts with the upper sections 28*b* to maintain flow separation between adjacent housing channels 30.

As best seen in FIG. 9, each adjustable deckle (one located at each end of the roll 14) includes a deckle plate 38 and a deckle membrane 40. The deckle plate 38 is an arcuate plate located in the space between the roll 14 and the first housing 16. The deckle plate 38 forms an imperfect, non-contacting seal with the outer surface of the roll 14 and can be moved in the cross-machine direction. One end of the deckle membrane 40 is attached to the first housing 16 and the other end is attached to the deckle plate 38 for movement therewith. The deckle membrane 40 thus limits the width of the supply air to the web width, and the deckle plate 38 prevents flow from bypassing the web 12. Because the deckle membrane 40 is primarily responsible for blocking the air flow, the deckle plate 38 optionally can be omitted. Either way, use of the hood deckles allows the two outermost flow control assemblies 32 to be completely closed. The deckle membrane 40 can be constructed from an expandable sheet of a high temperature material, such as a Viton® fluoroelastomer, or concentric, telescoping sheet metal ring segments. In operation, the positions of the two outermost flow dividers 24, the two outermost partitions 28, and the deckle plates are all adjusted to align, in the cross-machine direction, with the edges of the web 12. With this arrangement, the TAD 10 can easily accommodate webs of varying width.

While specific embodiments of the present invention have been described, it will be apparent to those skilled in the art that various modifications thereto can be made without departing from the spirit and scope of the invention as defined in the appended claims.

What is claimed is:

1. A through-air device comprising:

a permeable roll having a hollow interior and mounted for rotation about a longitudinal axis;

at least one divider located in said hollow interior so as to define a plurality of roll channels within said roll, said roll channels being positioned side-by-side along said longitudinal axis;

a first housing bounding a first portion of said roll;

a second housing bounding a second portion of said roll;

at least one partition located in said second housing so as to define a plurality of housing channels within said second housing, wherein each one of said housing channels is aligned with a corresponding one of said roll channels; and means for individually controlling air flow through each pair of corresponding roll channels and housing channels.

2. The through-air device of claim 1 wherein said first housing defines a supply plenum and said second housing defines an exhaust plenum.

3. The through-air device of claim 1 wherein said first housing defines an exhaust plenum and said second housing defines a supply plenum.

4. The through-air device of claim 1 wherein said means for individually controlling air flow comprises a flow control assembly located in each one of said housing channels.

5. The through-air device of claim 4 wherein each flow control assembly includes at least one rotatable damper.

6. The through-air device of claim 1 wherein said means for individually controlling air flow comprises a flow control assembly located in each one of said roll channels.

7. The through-air device of claim 6 wherein each flow control assembly includes an expandable member.

8. The through-air device of claim 1 further comprising an adjustable deckle located on at least one end thereof.

9. The through-air device of claim 1 wherein said means for individually controlling air flow can be adjusted to accommodate a tail threading operation.

10. A through-air device comprising:

a permeable roll having a hollow interior and mounted for rotation about a longitudinal axis;

a plurality of dividers located in said hollow interior so as to define a plurality of roll channels within said roll, said roll channels being positioned side-by-side along said longitudinal axis;

a first housing bounding a first portion of said roll;

a second housing bounding a second portion of said roll;

a plurality of partitions located in said second housing so as to define a plurality of housing channels within said second housing, wherein each one of said housing channels is aligned with a corresponding one of said roll channels; and means for individually controlling air flow through each pair of corresponding roll channels and housing channels.

11. The through-air device of claim 10 wherein said first housing defines a supply plenum and said second housing defines an exhaust plenum.

12. The through-air device of claim 10 wherein said first housing defines an exhaust plenum and said second housing defines a supply plenum.

13. The through-air device of claim 10 wherein said means for individually controlling air flow comprises a flow control assembly located in each one of said housing channels.

14. The through-air device of claim 13 wherein each flow control assembly includes at least one rotatable damper.

15. The through-air device of claim 10 wherein said means for individually controlling air flow comprises a flow control assembly located in each one of said roll channels.

16. The through-air device of claim 15 wherein each flow control assembly includes an expandable member.

17. The through-air device of claim 10 wherein said plurality of dividers includes two dividers that are adjustable in the direction of said longitudinal axis, and said plurality of partitions includes two partitions that are adjustable in the direction of said longitudinal axis.

18. The through-air device of claim 17 further comprising an adjustable deckle located on each end thereof.

19. The through-air device of claim 10 wherein said means for individually controlling air flow can be adjusted to accommodate a tail threading operation.

* * * * *